United States Patent [19]

Hutter, III

[11] 4,072,333

[45] Feb. 7, 1978

[54] REMOVABLE DOOR-LOCKING DEVICE

[75] Inventor: Charles G. Hutter, III, Hollywood, Calif.

[73] Assignee: Physical Systems, Inc., North Hollywood, Calif.

[21] Appl. No.: 736,832

[22] Filed: Oct. 29, 1976

[51] Int. Cl.[2] ..... E05C 19/18

[52] U.S. Cl. ..... 292/292

[58] Field of Search ..... 292/289, 292, 293, 294, 292/295, 296, 297, 298

[56] References Cited

U.S. PATENT DOCUMENTS

| | | | |
|---|---|---|---|
| 219,493 | 9/1879 | McKitrick | 292/292 |
| 939,785 | 11/1909 | Auger | 292/292 |
| 3,589,761 | 6/1971 | Lambert | 292/292 |

*Primary Examiner*—Paul R. Gilliam
*Assistant Examiner*—Kenneth J. Dorner
*Attorney, Agent, or Firm*—Fulwider, Patton, Rieber, Lee & Utecht

[57] ABSTRACT

A removable, portable door-locking device engages a recess in the door frame conventionally provided to receive a latch built into the door. A hook that engages this recess extends into the room from between the door and door frame and coacts with wedges that press against the door and frame to hold the door tightly closed.

4 Claims, 4 Drawing Figures

REMOVABLE DOOR-LOCKING DEVICE

BACKGROUND OF THE INVENTION

The present invention relates to door locks, and more particularly to door locks that are removable and portable for use with different doors.

The escalating crime rate has made it increasingly important for individuals to take effective steps to insure their own personal safety and the safety of their possessions. When an individual is on his own property he has some measure of control over the security of his physical environment, but his degree of control is greatly diminished when he becomes a temporary occupant of a hotel room or the like. It is generally possible to lock the room from the inside, if the lock works properly, but there is usually a keyhole that opens to the exterior of the room by which the lock may be opened with little difficulty by a skilled thief. Moreover, keys to hotel rooms are typically accessible to numerous hotel employees and previous guests, so that the security of the room is highly questionable at best.

Some measure of security can be provided by sliding bolts and chains that are operated from within the room, but these devices are not always provided and are often of such flimsy construction that they are of little help. It is of little avail for an individual to carry any of the commonly available portable locks, such as padlocks, since these devices require special fittings on the door and door frame. Another serious disadvantage of key or combination operated portable locks is that they can cause a person to be trapped in the room in the event of fire or other emergency.

A principal objective of the present invention is to provide a simple, easily operated, keyless door-locking device that can be used with conventional hotel room doors that are not provided with special fittings.

SUMMARY OF THE INVENTION

The present invention provides a removable, portable door-locking device that engages a recess in the door frame conventionally provided to receive a latch built into the door. A hook that engages this recess extends into the room from between the door and door frame and coacts with wedges that press against the door and frame to hold the door tightly closed. The device can be used with any conventional door. Since it is not accessible from the exterior of the room, it cannot be picked, jimmied, or otherwise tampered with. It does not require a key or combination and can be quickly and easily released in an emergency. The device is compact and lightweight so that it is readily carried in a suitcase without inconvenience.

More specifically, the door-locking device of the invention includes a pair of adjacent wedges each having an abutment surface and a locking surface that lies at an acute angle to the abutment surface. A hook projects from between the wedges so that it can be positioned between the door and the frame with the end of the hook inserted in a recess in the frame. A connecting means attached to the hook slidably engages the locking surfaces to hold the wedges in position. The abutment surface of one wedge presses against the door while the abutment surface of the other wedge presses against the frame. The hook holds both wedges tightly to secure the door in a closed position.

Other features and advantages of the present invention will become apparent from the following detailed description, taken in conjunction with the accompanying drawing, which illustrates, by way of example, the principles of the invention.

DESCRIPTION OF THE PREFERRED EMBODIMENT

Figure 1:
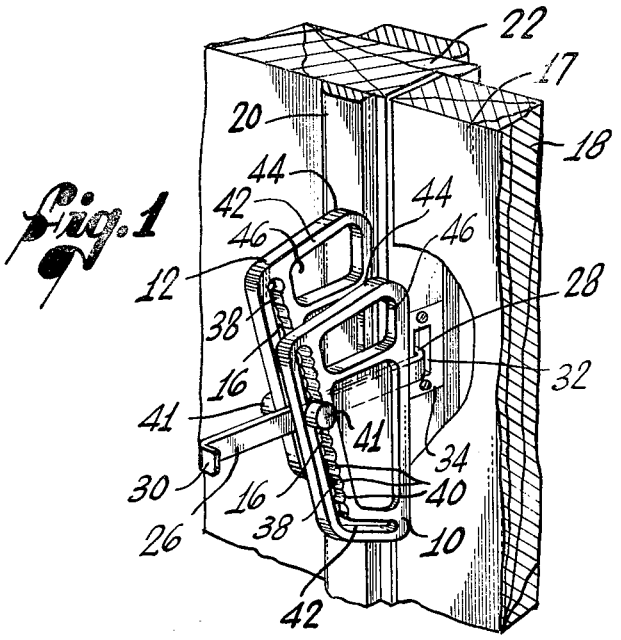
FIG. 1 is a perspective view of a door-locking device that embodies the present invention, shown in engagement with fragmentary portions of a door and door frame.

The present invention is a removable, keyless, door-locking device for use by occupants of hotel rooms and the like that does not require any special fittings for its attachment. It engages the recess in a door frame conventionally provided to receive a latch carried by a door hinged to the frame. The device is not accessible from outside the room so that it is essentially tamper-proof.

An exemplary door-locking device that embodies the invention (shown in the accompanying drawings) includes two adjacent molded plastic wedges 10 and 12. Each wedge has an abutment surface 14 and a locking surface 16 forming an acute angle of about 20° to 30°. With the device in its operative door-locking position on the inside of a room (FIG. 1, 3 and 4), the abutment surface of one wedge 10 engages the surface 17 of a closed door 18, while the abutment surface of the other wedge 12 engages the adjacent surface 20 of the door frame 22.

The wedges 10 and 12 are held in position by a hook 24 formed by an elongated metal strip. The hook includes a flat main body 26, the rounded ends 28 and 30 of which are bent in opposite directions to form right angles with the main body. One end 28 of the hook is inserted in a recess 32 defined by a conventional striker plate 34 on the edge of the door frame 22, this recess being part of the standard construction of a door frame and designed to receive a conventional latch (not shown) that is built in the edge of the door 18. The main body of the hook extends through the space between the door 18 and the frame 22 and is held between the wedges normal to the abutment surface 14. The unused end 30 of the hook extends beyond the opposite edges of the wedges into the room.

Figure 3:
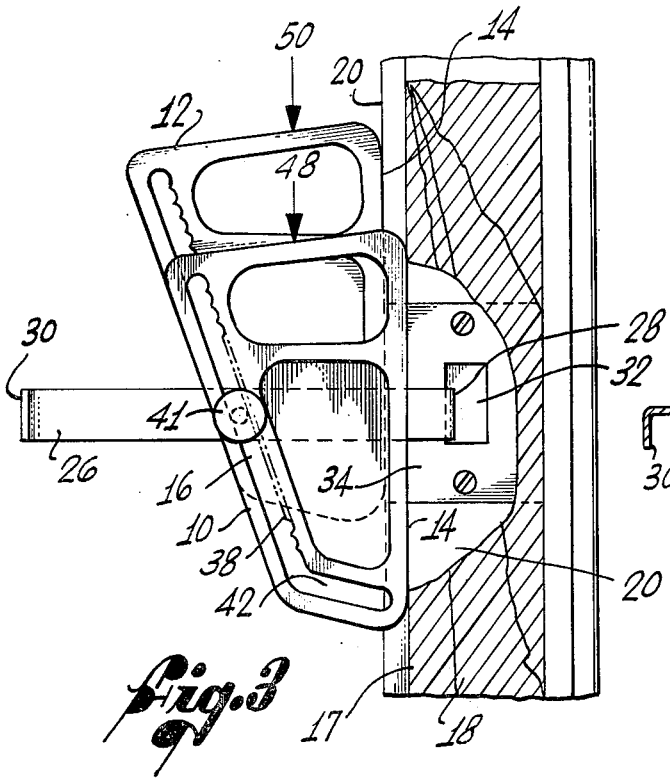
FIG. 3 is a side elevation of the device of FIG. 1, showing partially broken-away fragmentary portions of the door and frame in locked position.

Extending perpendicularly through the center of the body 26 of the hook 24 is a pin 36 for engaging the locking surfaces 16 of the wedges 10 and 12 and thereby pressing the wedges against the door 18 and frame 20. As best seen in FIGS. 1 and 3, each wedge has a slot 38 through which one end of the pin 36 extends, with the side of the slot closer to the abutment surface acting as the locking surface 16. A series of closely spaced, parallel, concaved detents 40 formed in each locking surface ensures positive engagement of the locking surface by the pin 36 when the wedge is tightly held by the hook. However, the slots have a width greater than the diameter of the pin so that the pin can slide freely along the locking surfaces when pressure is not applied by the hooks. A secondary slot 42 extends from the lower end of each main slot 38 toward the abutment surface and provides a path along which the pin projecting into that slot can move more directly toward the abutment surface. The secondary slots 41 thus permit the hook 24 to be moved to a position in which it projects a maximum amount from between the wedges to facilitate easier installation and removal of the device. Retaining knobs 41 on the outer ends of the pin 36 prevent the pin from being withdrawn from the slots 38 and also facilitate the movement of the pin with respect to the wedges 10 and 12 so that the component parts of the locking device are inseparable but movable with respect to each other.

The wedges 10 and 12 are generally triangular in outline, although truncated at their pointed ends to follow the lines of the secondary slots 42. The base of the triangle, which is normally at the top when the wedges are in their operative positions, is thickened to form a strut 44 that connects one end of the locking surface 16 to the corresponding end of the abutment surface 14. An opening 46 in each wedge just below the strut 44 permits the strut to be conveniently grasped as a handle when the device is being installed or removed.

Figure 2:
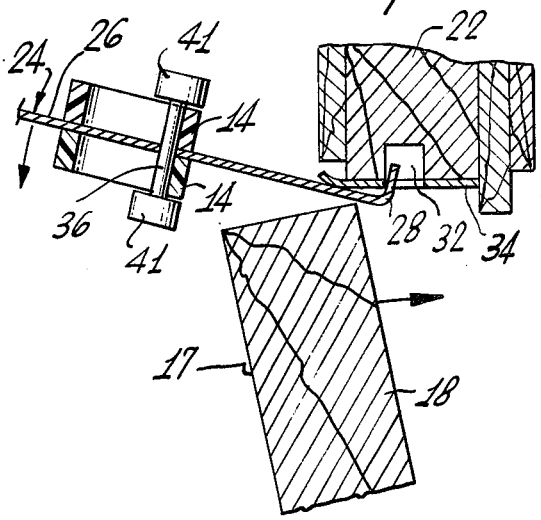
FIG. 2 is a cross-sectional view, taken along a horizontal plane, of the device of FIG. 1 showing fragmentary portions of a door and frame in the process of being locked and unlocked.

To most conveniently install the invention in its door-locking position, the door should be opened into the room so that it is slightly ajar (FIG. 2). The pin 36 is moved to the ends of the secondary slots 42 closest to the abutment surfaces 14 so that the hook 24 projects from between the abutment surfaces to the maximum extent. The projecting main body 26 of the hook is positioned between the door 18 and the frame 22 and one hook end 28 is inserted in the recess 32 defined by the striker plate 34. It should be noted that the hook can be rotated about the pin 41 to select the end, 28 or 30, that is bent in the direction of the recess. It is, therefore, possible to position the wedges with the struts 44 on top regardless of whether the door is hinged on its right or left side.

Figure 4:
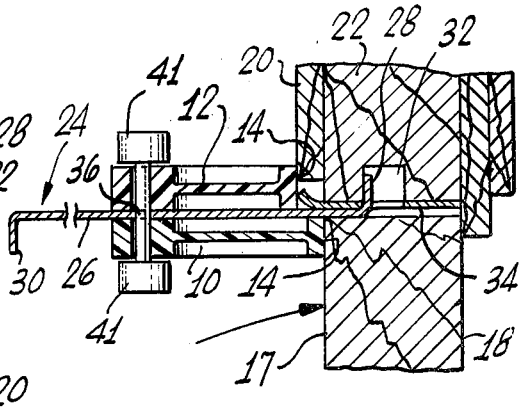
FIG. 4 is a cross-sectional view, similar to FIG. 2, showing fragmentary portions of the door and frame in locked position.

After the end 28 of the hook 24 has engaged the recess 32, the door 18 is closed so that flat main body 26 of the hook is held between the opposing surfaces of the door 18 and the frame 22 (FIG. 4). Then one of the wedges 10 is moved downwardly (as indicated by the arrow 48 in FIG. 3) until one of the detents 40 in its locking surface 16 firmly engages the pin 36 and the abutment surface 14 is firmly wedged against the door 18. The other wedge 12 is similarly moved downwardly (arrow 50) until the pin on the opposite side of the hook engages one of the detents on its locking surface and its abutment surface is wedged against the frame 22. If the surface of the door 18 is recessed from the surface of the frame 22, the wedge that engages the door will move downwardly further than the wedge that engages the frame, but portions of the main slots 38 continue to overlie each other in the area of the pin 36.

With the locking device in its operative position, the door 18 is firmly held in a closed position by the wedge 10, which is firmly anchored by the hook 24 to the recess 32 of the frame 22. The wedge 12, which abuts the frame, resists any tendency of the main body 26 of the hook to bend away from the door. Although it is preferable to have two wedges, it is possible to omit the wedge that engages the frame if the hook has sufficient rigidity.

The lock can be quickly and easily removed by simply pulling upwardly on the struts 44 of the wedges to release the wedging pressure that forces the pin 36 against the locking surfaces. The pin is then moved into the secondary slots 42, so that the door can be opened while the hook 24 is pivoted and withdrawn from the path of the door.

It will be apparent from the above description that the removable door-locking device of the present invention is simple, lightweight and compact, but is capable of securely locking a door of standard construction without requiring a modification of the door or special fittings of any kind. The device is not accessible from outside the room so that it is not readily subject to tampering, and it is easily released without a key or combination in the event of an emergency. The device will not deface or otherwise damage a conventional door, and tools are not required for its installation.

While a particular form of the invention has been illustrated and described, it will be apparent that modifications can be made without departing from the spirit and scope of the invention.

I claim:

1. For use with a door that is pivotably mounted in a frame, the door having a latch movable into a cooperating recess in the frame, a removable door-locking device comprising:

a pair of adjacent wedges each having an abutment surface and a locking surface that lies at an acute angle to said abutment surface, each of said wedges having a main slot bounded on one side by said locking surface and a secondary slot extending from said main slot toward said abutment surface to permit said connecting means to move toward said abutment surface;

a hook having a body portion normal to said abutment surfaces that is at least partially disposed between said wedges and capable of projecting from between said wedges past said abutment surfaces, and at least one end portion extending from said body portion at an angle thereto for insertion in said recess; and connecting means attached to said hook for slidably engaging said locking surfaces;

whereby one of said abutment surface can engage the door while the other of said abutment surfaces engages the frame to hold the door in a closed position.

2. The device of claim 1, wherein said connecting means comprises a pin which extends from said hook, and into said slots.

3. The device of claim 2, wherein said connecting means further includes retaining means for preventing said pin from being removed from said slots.

4. For use with a door, and a frame on which the door is hinged that includes a recess for engagement by a latch carried by the door, a removable door locking device comprising:

a pair of adjacent wedges each having an abutment surface and having a slot one side of which is formed by a locking surface that lies at an acute angle to the abutment surface, said locking surface defining a series of closely spaced detents, each wedge including a secondary slot that extends from said first-mentioned slot toward said abutment surface to permit movement of said pin toward said abutment surfaces;

a hook formed by an elongated metal strip having a flat main body and two end portions bent in opposite directions to form right angles with said main body, said main body being at least partially disposed between said wedges and movable with respect to said wedges;

a pin extending from said hook into said slots to engage selected detents on said locking surface; and retaining means for preventing removal of said pin from said slots;

whereby one of said end portions can be inserted in the recess of the frame and the positions of said pin relative to said locking surfaces can be adjusted so that the abutment surface of one of said wedges engages the door and the abutment surface of said other wedge engages the frame to hold the door in a closed position.

* * * * *